US007100922B2

(12) United States Patent
Maeda et al.

(10) Patent No.: US 7,100,922 B2
(45) Date of Patent: Sep. 5, 2006

(54) BULL'S EYE TARGET DEVICE

(75) Inventors: Tetsuo Maeda, Tokyo (JP); Yoshiyuki Maeda, Tokyo (JP)

(73) Assignee: MARUZEN Company Limited, Tokyo (JP)

( * ) Notice: Subject to any disclaimer, the term of this patent is extended or adjusted under 35 U.S.C. 154(b) by 0 days.

(21) Appl. No.: 11/002,097

(22) Filed: Dec. 3, 2004

(65) Prior Publication Data

US 2006/0006597 A1 Jan. 12, 2006

(30) Foreign Application Priority Data

Jul. 9, 2004 (JP) ..... 2004-203083

(51) Int. Cl.
*F41J 5/04* (2006.01)

(52) U.S. Cl. ..... 273/374

(58) Field of Classification Search ..... 273/374, 273/376

See application file for complete search history.

(56) References Cited

U.S. PATENT DOCUMENTS 804,712 A * 11/1905 Ellis ..... 273/374
865,604 A * 9/1907 Meyer ..... 273/374
1,005,008 A * 10/1911 Ellis ..... 273/374
1,096,292 A * 5/1914 Ellis ..... 273/374
1,306,048 A * 6/1919 Coy ..... 273/374
1,402,523 A * 1/1922 Michoud ..... 273/374
1,650,940 A * 11/1927 Hill ..... 273/374
2,487,871 A * 11/1949 Havey ..... 273/374
3,690,661 A * 9/1972 Scharz et al. ..... 273/374
5,718,433 A * 2/1998 Lu et al. ..... 273/374

OTHER PUBLICATIONS

Kabushikigaisha Kokusai shupan, Monthly Magazine "Gun", Jan. 1990, front and back covers and pp. 67 and 108, with translation of portions.

* cited by examiner

*Primary Examiner*—Mark S. Graham
(74) *Attorney, Agent, or Firm*—Foley & Lardner LLP

(57) ABSTRACT

A bull's eye target device with a target surface section provided with a central section and a plurality of ring sections, and a circuit substrate provided so as to be spaced from the rear surface of the target surface section. The front surface side of the target surface section is formed in such a manner that the central section is raised to the greatest extent, with the plurality of ring sections becoming relatively lower as the periphery is approached, and a central pressing part and plurality of ring-shaped pressing parts are formed so as to project at the rear surface side at positions corresponding to the central section and the plurality of ring sections. The circuit substrate is provided with circular independent terminals at positions corresponding to the central pressing part and plurality of ring-shaped pressing parts of the target surface section.

22 Claims, 8 Drawing Sheets

BULL'S EYE TARGET DEVICE

BACKGROUND OF THE INVENTION

1. Field of the Invention

The present invention relates to a so-called bull's eye target device that is a device used in matches, training, and games for firing pellets at a target from a position five to ten meters away using a match pistol or sports pistol.

A bull's eye target match is typified by a precision target match and is a match utilized in basic training by a large number of pistol marksmen. For example, a bull's eye target match in a precision target match known as the "APS cup in Japan" held ten years previously, is a competitive game where a competitor fires five pellets at a target over the course of two minutes, with this being repeated twice to obtain a points total.

The so-called bull's eye target used in the bull's eye target match is a disc-shaped target where a plurality of concentric rings of fixed widths go outwards from a so-called maximum points-scoring central part, and in the match a plurality of pellets are fired towards the target within a fixed period of time decided by the participants to get a points total. A higher number of points are then scored when a pellet hits concentric circles that are closer to the center.

In this bull's eye target game, in the event that a pellet touches a boundary line of the target, rather than the points being decided according to which boundary line is more impinged by the contact with the pellet so that the pellet makes contact with a larger surface area of one scoring circle, the points are taken to be that of the innermost boundary line with which contact is made even if the contact is slight, i.e. the higher points are adopted.

2. Description of the Background Art

Targets where the surface of the target is made of paper or pressure-sensitive paper are well-known as related art technology for bull's eye target devices (related art technology 1). In related art technology 1, the position of the surface of the target where the pellet makes an impact has a round trajectory. It is therefore convenient and accurate to determine whether or not a pellet has made contact with a boundary line.

Further, bulls eye target devices having, in addition to the target, connection lines connecting electrically with the target so as to enable points for pellets that impact the target to be displayed on a display unit using electrical signals are known (related art 2). Devices that are provided with pressure-sensitive sensors at the rear surface or front surface of a target that electrically conduct upon the impact of a pellet so as to enable the points for the portion where there has been an impact to be displayed on a display unit are also well-known as a bulls eye target device.

However, in the event of using a target with a surface made of paper or a target with a surface made of pressure-sensitive paper as in related art 1, there is no automatic display unit and it is therefore necessary for the points total etc. to be added up after the match by the participant themselves or by a judge.

Further, in related art 1, in the event that a match trainer is practicing in a room etc. or is a participant in a match, because the target is a long way away and cannot be seen clearly it is not possible for a participant to be aware of their current score and the total score therefore cannot be confirmed during a match.

Further, the target of related art 1 is made of paper. This means that pellet marks from a previous occasion cannot be removed which makes it difficult to discern the old pellet marks from the new pellet marks and makes repeated use of a target impossible.

Further, related art 2 has the advantage that, when a pellet impacts with the surface of the target, this pressure is sensed by a pressure sensor, converted to an electrical signal and sent to a display unit for displaying, so that the total number of points can be seen if a long enough cord is used to connect the target surface and the display unit. However, in related art 2, the pressure sensor may not correctly respond because the speed and strength with which the pellet impacts with the target surface is not fixed.

In related art 2, in the event that the pellet impacts with the boundary line of the target surface, the points for one side or the other are displayed but in this case the side of the pressure sensor that responds is displayed. Typically, when the contact range of the impact point is large, then a strong pressure is felt, which makes the likelihood of an incorrect points display that is different to reality high. For example, in the event that the impact range is more to the outside than the boundary line, then in a match it is necessary to adopt the higher points to the inside of the boundary line. However, in related art 2, the point where greater pressure is felt or where faster contact is made will be displayed giving a higher likelihood of the outer side where the points are lower being displayed. This therefore causes erroneous displaying and means that there is a problem where, because these are added up, erroneous displaying and erroneous operation occurs more easily as the number of impacts from shots increases, and the points total therefore also becomes inaccurate.

SUMMARY OF THE INVENTION

An advantage of the invention is in providing a device capable of accurately determining a position to which a pellet has been fired and instantaneously sending points to a display unit. Namely, because the target surface is such that inside and outside of boundary lines are at different heights, in the event of an impact making contact with a boundary line, a pellet will always impact with and apply pressure to the inside part of the target for which the points are higher. A terminal of a circuit substrate corresponding to this higher points side then makes contact so as to provide excitation, and the points can be accurately displayed.

In an aspect of the invention as disclosed in claim 2, the contact plate is provided with a contact surface capable of deformation in a direction towards the rear surface at a position corresponding to the central pressing part and plurality of ring-shaped pressing parts at the target surface section at the rear surface, with boundary projections being provided in ring-shapes at boundaries of the rear surface of the respective contacting surfaces. This means that pressing force of the pellet is not dissipated to parts for other points, so that points can be displayed in a more accurate manner. A cross-sectional illustration of a target section where a pellet has impacted with a target display section in the event that ring-shaped boundary projections are not provided at the rear surface side of the contact plate is shown in FIG. 14.

A bull's eye target device of this invention comprises a target section and a display unit capable of being electrically connected with the target section.

The target section is provided with a target surface section provided with a central section and a plurality of ring sections provided outside the central section so as to be concentric with the central section, and a circuit substrate provided at the rear surface side of the target surface section so as to be distanced from the rear surface of the target surface section.

The surface side of the target surface section is formed in such a manner that the central section is raised to the greatest extent, with the plurality of ring sections becoming relatively lower as the periphery is approached, and a central pressing part and plurality of ring-shaped pressing parts are formed projecting in corresponding shapes at the rear surface side at positions corresponding to the central section and the plurality of ring sections.

The circuit substrate is provided with circular or annular independent terminals at positions corresponding to the central pressing part and plurality of ring-shaped pressing parts of the target surface section.

Here, a corresponding circuit is energized due to one central pressing part or ring-shaped pressing part making contact with one respectively corresponding terminal of the circuit substrate as a result of a pellet impacting with one of the central section or ring sections of the front side of the target surface section of the target section, so that a signal corresponding to the contacted terminal is sent to the display unit.

Further, the bull's eye target device of this invention may comprise a target section and a display unit capable of being electrically connected with the target section.

The target section is comprised of at least a target surface section provided with a central section and a plurality of ring sections provided outside the central section so as to be concentric with the central section, a contact plate provided so as to be capable of deforming when pressed at the rear surface side of the target display section, and a circuit substrate provided at the rear surface side of the contact plate so as to be distanced from the rear surface of the contact plate.

The surface side of the target surface section is formed in such a manner that the circular central section is raised to the greatest extent, with the plurality of ring sections becoming relatively lower as the periphery is approached, and a circular central pressing part and plurality of ring-shaped pressing parts are formed at the rear surface side so as to correspond to the central section and the plurality of ring sections.

The surface constituting the target surface section side surface of the contact plate is taken to be a pressed surface pressed by the central pressing part and the plurality of ring-shaped pressing parts of the target surface section, and the rear surface side is taken to be a contacting surface making contact with the circuit substrate in the event of deformation due to pressing, and with boundary projections projecting in ring-shapes being formed at positions corresponding to respective boundaries of the central pressing part and plurality of ring-shaped pressing parts of the target surface section at the rear surface side.

The circuit substrate is provided with circular or annular independent terminals at positions corresponding to the central pressing part and plurality of ring-shaped pressing parts of the target surface section.

A corresponding circuit is energized due to one corresponding central pressing part or ring-shaped pressing part pressing one contact surface of the contact plate as a result of a pellet impacting with one of the circular central section or ring sections of the front side of the target surface section of the target section, so that a signal corresponding to the contacted terminal is sent to the display unit.

The respective central section and plurality of ring sections of the target surface section are formed in such a manner as to deform independently in the event that a pellet impacts with one of the central section or the ring sections at the surface side, so that a corresponding central pressing part or ring pressing part makes contact with a corresponding terminal of the circuit substrate first.

DETAIL DESCRIPTION OF THE PREFERRED EMBODIMENTS

Figure 3:
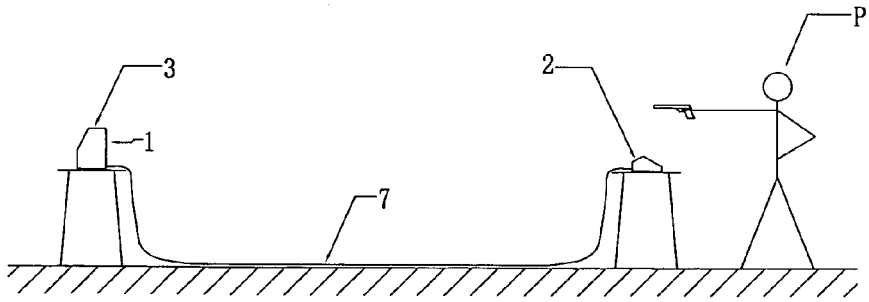
FIG. 3 is a view illustrating usage in a match or training situation where the bull's eye target device of the same embodiment of this invention is employed.
Figure 4:
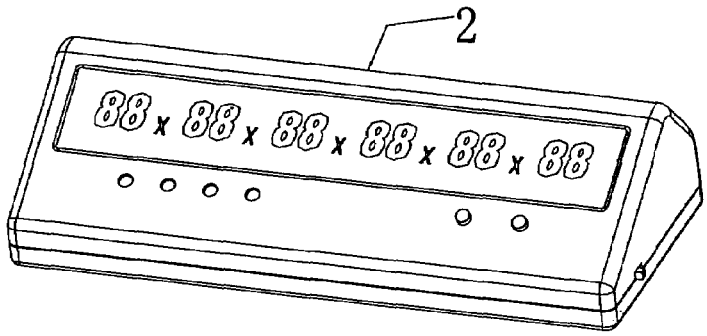
FIG. 4 is a perspective view of a display unit of the same.
Figure 10:
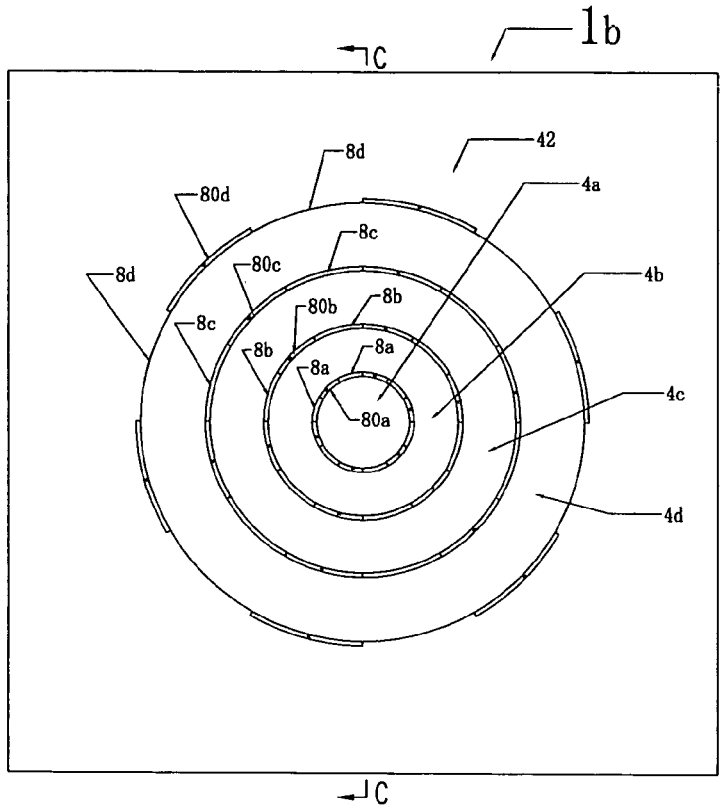
FIG. 10 is a front view of a target surface section of a target of a second embodiment of this invention.
Figure 11:
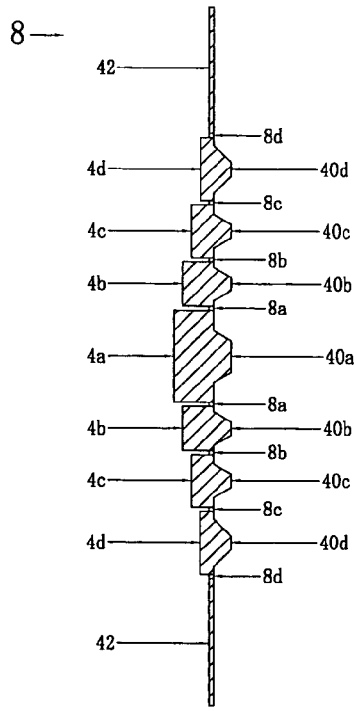
FIG. 11 is a cross-section along line CC of FIG. 10 of the same.

A description is now given based on FIG. 1 to FIG. 13 showing bull's eye target devices of embodiments of this invention. With regards to a target section 1, FIG. 1, FIG. 2, and FIG. 5 to FIG. 9 show a target section 1*a* of a first embodiment, FIG. 10 and FIG. 11 show a target surface section 8 of a target section 1*b* of a second embodiment, and FIG. 13 shows a target section 1*c* of a third embodiment. The bull's eye target device of the embodiments of the invention is comprised of a target section 1 provided at a target case 3 as shown in FIG. 3, and a display unit 2 (FIG. 4) electrically connected to the target section 1 by a cable 7, etc. The cable 7 may be of an appropriate length but is typically in the order of 5 m to 10 m.

Figure 1:
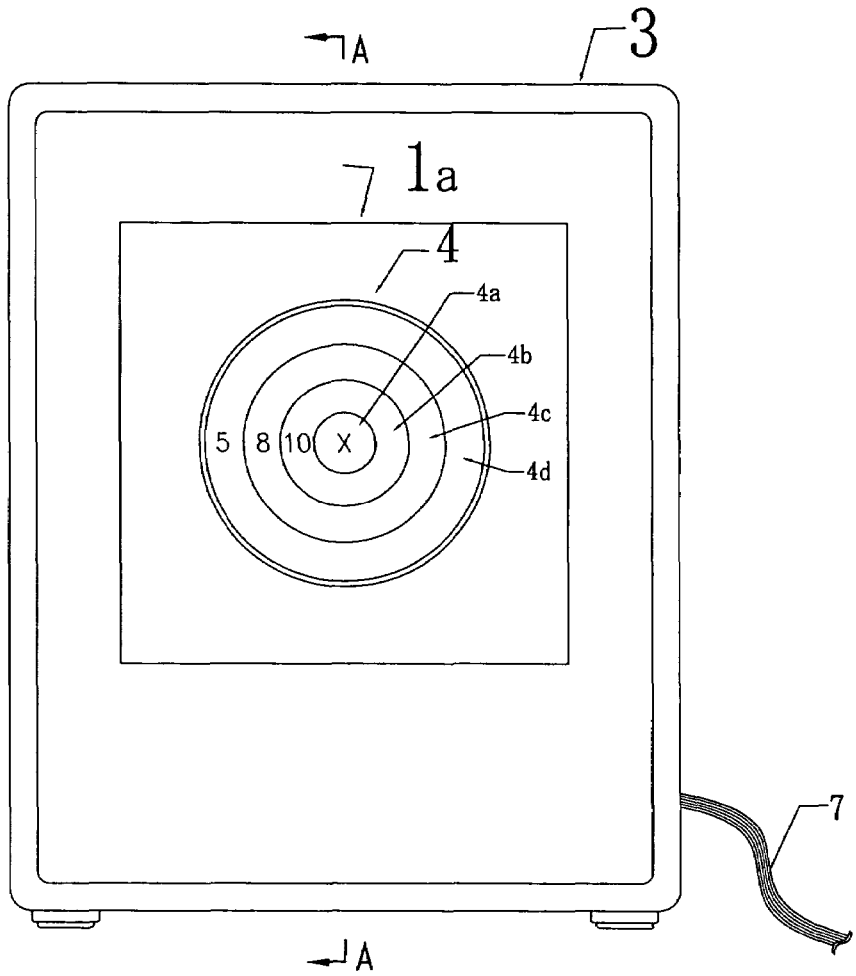
FIG. 1 shows an embodiment of this invention and is a front view of a target case for a bull's-eye target device.
Figure 2:
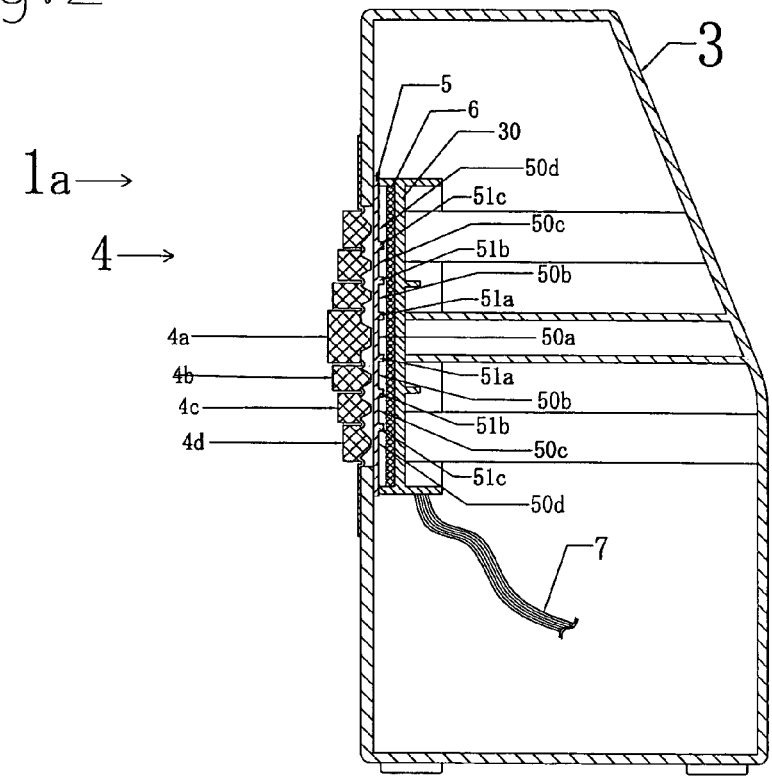
FIG. 2 is a cross-sectional view along AA of that of FIG. 1.

As shown in FIG. 1 showing the front surface of the target case 3 and FIG. 2 showing a cross-sectional view along AA of FIG. 1, the target section 1 is comprised of at least a target surface section 4 provided with a circular central section 4*a*, and three ring sections 4*b*, 4*c* and 4*d* provided outside the circular central section 4*a* so as to be concentric with the circular central section 4*a*, a contact plate 5 that deforms when pressed provided at the rear surface side of the target surface section 4, and a circuit substrate 6 provided distanced from the rear surface of the contact plate 5 at the rear surface side of the contact plate 5. Numeral 30 is a substrate case and is fixed to the target case 3.

Figure 5:
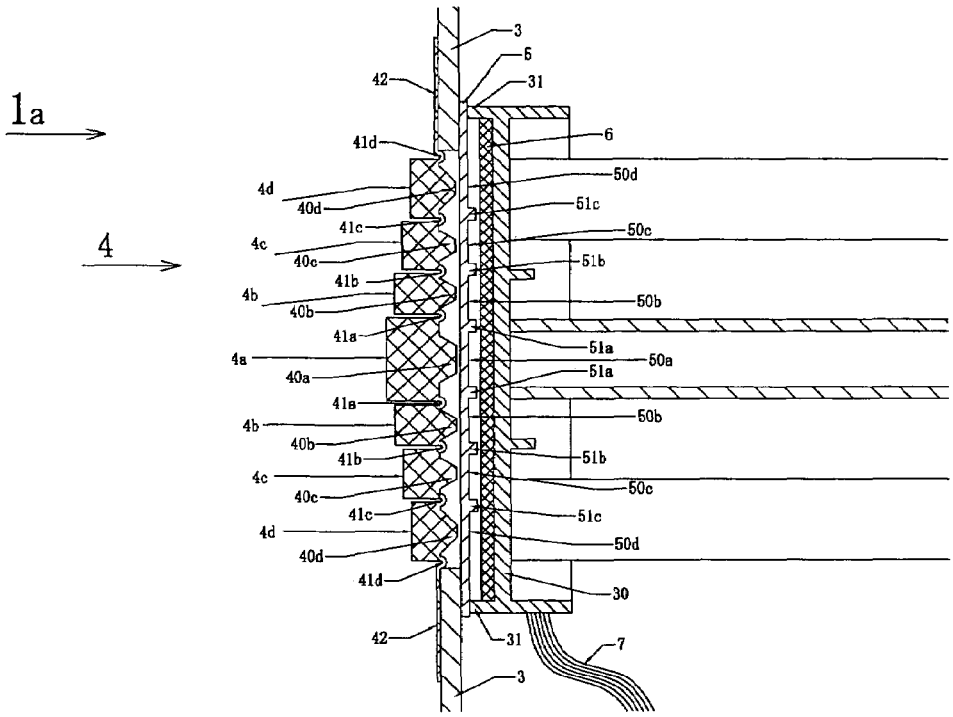
FIG. 5 is a longitudinal cross-sectional view of the target section of the first embodiment of the invention.

The target surface section 4 is comprised of the circular central section 4*a* and a plurality of ring sections concentric with the circular central section 4*a* and outside of the circular central section 4*a*, with there being three ring sections 4*b*, 4*c* and 4*d* in this embodiment. The target surface section 4 is formed in such a manner that the height of the circular central section 4*a* that gives the most points at the front surface of the target surface section 4 is raised to the greatest extent, with an outermost third ring section 4*d* giving the lowest number of points being raised to the least extent. Namely, as shown in FIG. 5, a first ring section 4*b* neighboring the outside of the circular central section 4*a* is formed so that its surface is slightly less raised than that of the circular central section 4*a*, a second ring section 4*c* neighboring the outside of the first ring section 4*b* is formed so that its surface is slightly less raised than that of the first ring section 4*b*, and the outermost third ring section 4*d* neighboring the outside of the second ring section 4*c* is formed so that its surface is slightly less raised than the second ring section 4*c*. A non-scoring surface 42 that is still less raised is then formed on the outside of the outermost third ring section 4*d* so as to cover the case surface of the target case 3.

Figure 8:
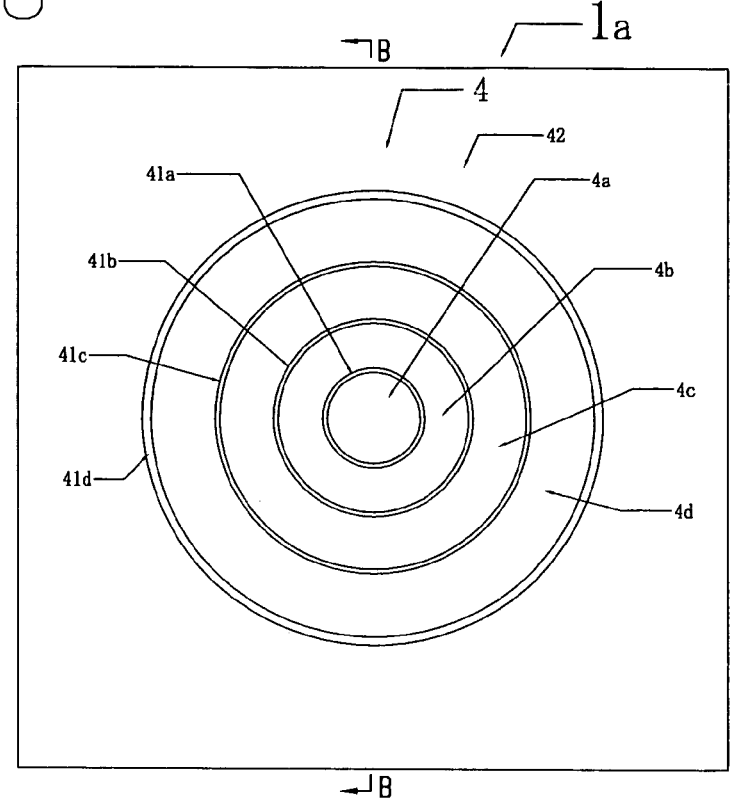
FIG. 8 is a front view of a target surface section of a target of the same first embodiment.
Figure 9:
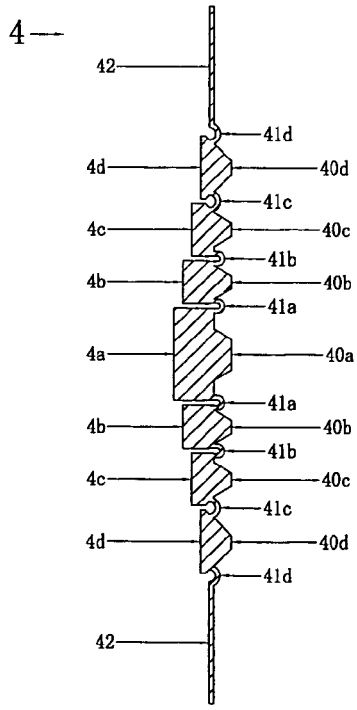
FIG. 9 is a cross-section along line BB of FIG. 8 of the same.

In a first embodiment of a target surface 4 shown in FIG. 8 and FIG. 9, four ring-shaped connecting parts 41*a*, 41*b*, 41*c* and 41*d* that are U-shaped in cross-section connect between the circular central section 4*a* and the first ring section 4*b* of the target surface section 4, between the first ring section 4*b* and the second ring section 4*c*, between the second ring section 4*c* and the third ring section 4*d*, and between the third ring section 4*d* and the non-scoring surface 42 so as to form a single integral body.

Further, in the second embodiment of the target surface section 8 shown in FIG. 10 and FIG. 11, a single integrated body is formed as a result of portion-connecting parts 8*a*, 8*b*, 8*c* and 8*d* respectively connecting between the circular central section 4*a* and the first ring section 4*b*, the first ring section 4*b* and the second ring section 4*c*, the second ring section 4*c* and the third ring section 4*d*, and the third ring section 4*d* and the non-scoring surface 42 of the target surface section 8. Here, a plurality of notches 80*a*, 80*b*, 80*c* and 80*d* are provided at appropriate positions, in appropriate numbers and of appropriate dimensions midway between the rings.

Further, at the target surface section 4, a circular central pressing part 40*a* and three circularly projecting rings of a first ring-shaped pressing part 40*b*, second ring-shaped pressing part 40*c* and third ring-shaped pressing part 40*d* are formed so as to project in a direction towards the rear surface on the rear surface side so as to correspond to the circular central section 4*a* and the three ring-shaped sections of the first ring section 4*b*, second ring section 4*c*, and third ring section 4*d*. The pressing end surfaces on the rear surfaces of the circular central pressing part 40*a*, first ring-shaped pressing part 40*b*, second ring-shaped pressing part 40*c* and third ring-shaped pressing part 40*d* are arranged in positions so as to be flat with respect to each other.

The circular central section 4*a*, first ring section 4*b*, second ring section 4*c*, third ring section 4*d*, non-scoring surface 42, connecting parts 41*a*, 41*b*, 41*c* and 41*d*, and the circular central pressing part 40*a* and ring-shaped pressing parts 40*b*, 40*c*, and 40*d* that constitute the surface of the target surface section 4 of the first embodiment are formed integrally from resilient elements such as soft synthetic resin or synthetic rubber. The circular central section 4*a*, first ring section 4*b*, second ring section 4*c*, third ring section 4*d*, non-scoring surface 42, connecting parts 8*a*, 8*b*, 8*c*, and 8*d*, the circular central pressing part 40*a* and ring-shaped pressing parts 40*b*, 40*c*, and 40*d* that constitute the surface of the target surface section 8 of the second embodiment shown in FIG. 10 and FIG. 11 are formed integrally from resilient elements such as soft synthetic resin or synthetic rubber as in the first embodiment.

In a further embodiment of the target surface section 4, the connecting parts 41*a*, 41*b*, 41*c* and 41*d* are not provided, and after forming the circular central section 4*a*, first ring section 4*b*, second ring section 4*c*, third ring section 4*d* and non-scoring surface 42 independently, linking may be provided so as to enable mutually independent operation. It is also possible to form the target surface sections 4 and 8 by first forming the respective pressing parts 40 independently from the plate for the front surface sides of the target surface sections 4 and 8, and the fixing using adhesive etc. from the rear surface side of the plate body of the front surface side.

The contact plate 5 is formed from a material that has both conductivity and resilience. In this embodiment, the contact plate 5 is formed of contact rubber. The contact plate 5 composed of contact rubber is formed so that the front surface constituting the side of the target surface section 4 is flat, the circular central pressing part 40*a*, first ring-shaped pressing part 40*b*, second ring-shaped pressing part 40*c* and third ring-shaped pressing part 40*d* of the target surface section 4 are formed so as to be spaced at equal distances so as to be provided as surfaces subjected to pressing that are capable of being pressed.

A central contact surface 50*a*, first ring-shaped contact surface 50*b*, second ring-shaped contact surface 50*c*, and third ring-shaped contact surface 50*d* are formed at positions corresponding to the positions of the circular central pressing part 40*a*, first ring-shaped pressing part 40*b*, second ring-shaped pressing part 40*c*, and third ring-shaped pressing part 40*d* of the target surface section 4 at the rear surface side of the contact plate 5 and are capable of making contact with respective circuit terminals of the circuit substrate 6 at the time of pressing deformation.

Further, the contact plate 5 is also formed with a first boundary projection 51*a*, second boundary projection 51*b*, and third boundary projection 51*c* projecting in the shape of rings at positions corresponding to the boundaries of the circular central pressing part 40*a*, first ring-shaped pressing part 40*b*, second ring-shaped pressing part 40*c* and third ring-shaped pressing part 40*d* of the target surface section 4 at the rear surface side. The circular central contact surface 50*a* at the rear surface side of the contact plate 5 therefore encompasses the first boundary projection 51*a* projecting in a ring-shape. Further, the first ring-shaped contact surface 50*b* is a ring-shaped surface encompassed by the first boundary projection 51*a* and the second boundary projection 51*b*. Similarly, the second ring-shaped contact surface 50*c* is a ring-shaped surface encompassed by the second boundary projection 51*b* and the third boundary projection 51*c*. Similarly, the third ring-shaped contact surface 50*d* is a ring-shaped surface encompassed by the third boundary projection 51*c* and a ring-shaped projection 31 of the substrate case 30 at an outer periphery thereof.

Figure 12:
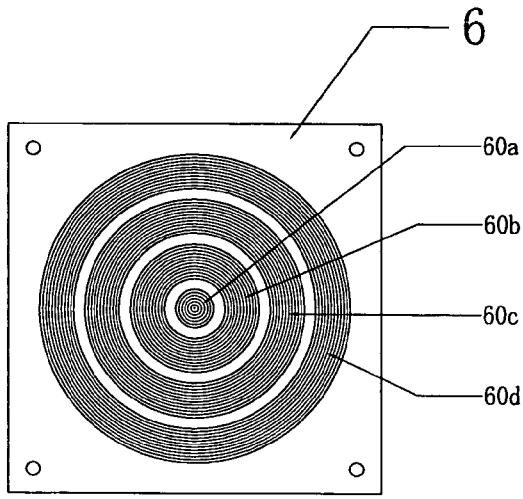
FIG. 12 is a front view of a circuit substrate constituting the second embodiment of this invention.
Figure 13:
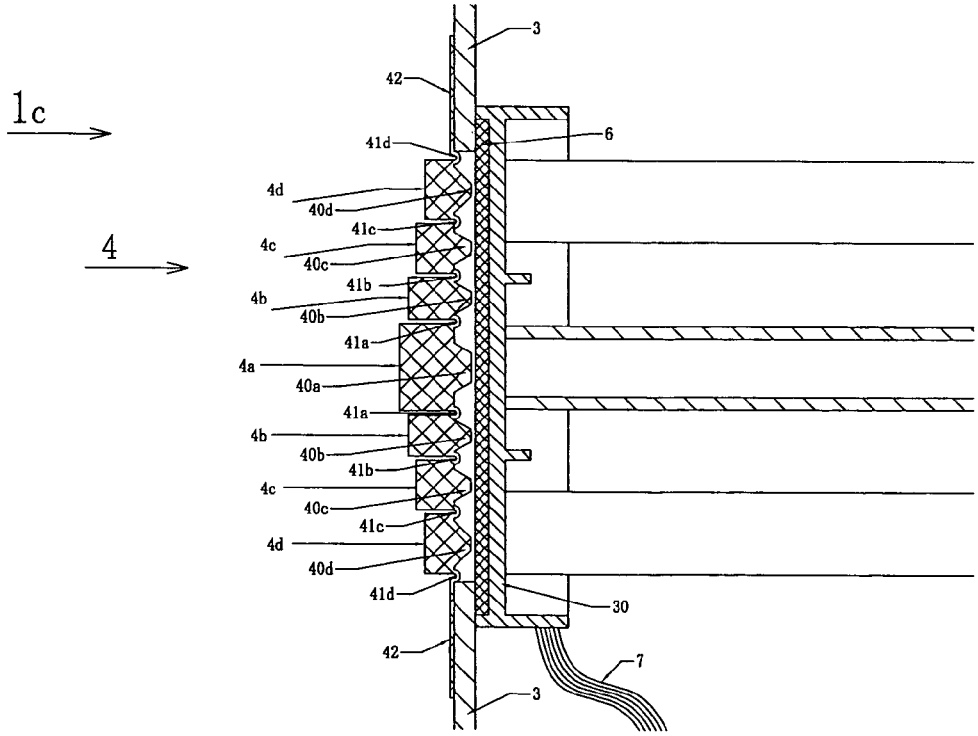
FIG. 13 is a longitudinal cross-sectional view of the target section of a third embodiment of the invention.

The circuit substrate 6 is independently provided with a circular central terminal 60*a* at a position corresponding to the circular central pressing part 40*a* of the target surface section 4 as shown in FIG. 12, a ring-shaped first terminal 60*b* at a position corresponding to the first ring-shaped pressing part 40*b*, a ring-shaped second terminal 60*c* at a position corresponding to the second ring-shaped pressing part 40*c*, and a ring-shaped third terminal 60*d* at a position corresponding to the third ring-shaped pressing part 40*d*. As a result of the central terminal 60*a*, first terminal 60*b*, second terminal 60*c* and third terminal 60*d* making contact with the corresponding central contact surface 50*a*, first ring-shaped contact surface 50*b*, second ring-shaped contact surface 50*c*, and third ring-shaped contact surface 50*d*, only the circuitry corresponding to where contact was made is energized. Signals corresponding to terminals 60*x* that make contact are then transmitted to the display unit 2 placed close to the shooter via the cable 7 so that corresponding points can be displayed on the display unit 2.

The display unit 3 is compatible with a bull's eye target match and is for competing on total points where five shots are fired and this is repeated twice and therefore has a plurality of numeric display parts for electrically displaying the points corresponding to each of five shots and the corresponding points total numerically.

Next, a description is given of the operation of a bull's eye target device constituting the first embodiment of this invention. The bull's eye target device is such that the display unit 2 is placed close to the shooter 3 so as to be visible as shown in FIG. 3, with the target case 3 being positioned approximately five meters away with the surface provided with the target surface section 4 facing the shooter P. When the shooter P fires a pellet B towards the target surface section 4 of the target case 3, as shown in FIG. 6 and FIG. 7, the pellet B impacts with either the circular central section 4*a*, first ring section 4*b*, second ring section 4*c*, third ring section 4*d* or non-scoring surface 42 of the target surface section 4.

Figure 6:
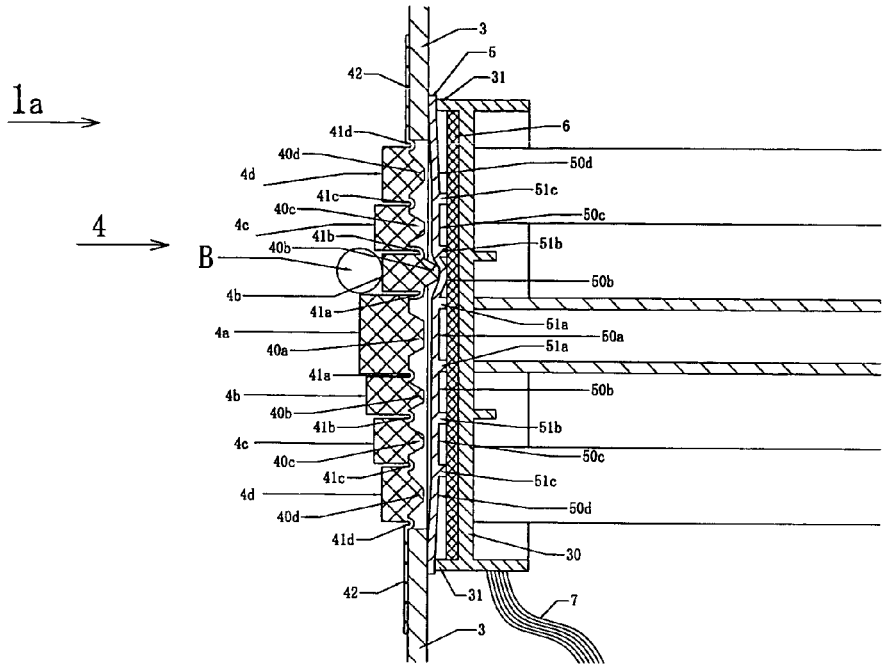
FIG. 6 is a longitudinal cross-section of the target section of the same first embodiment, and shows the situation when a pellet impacts with a first ring portion.
Figure 7:
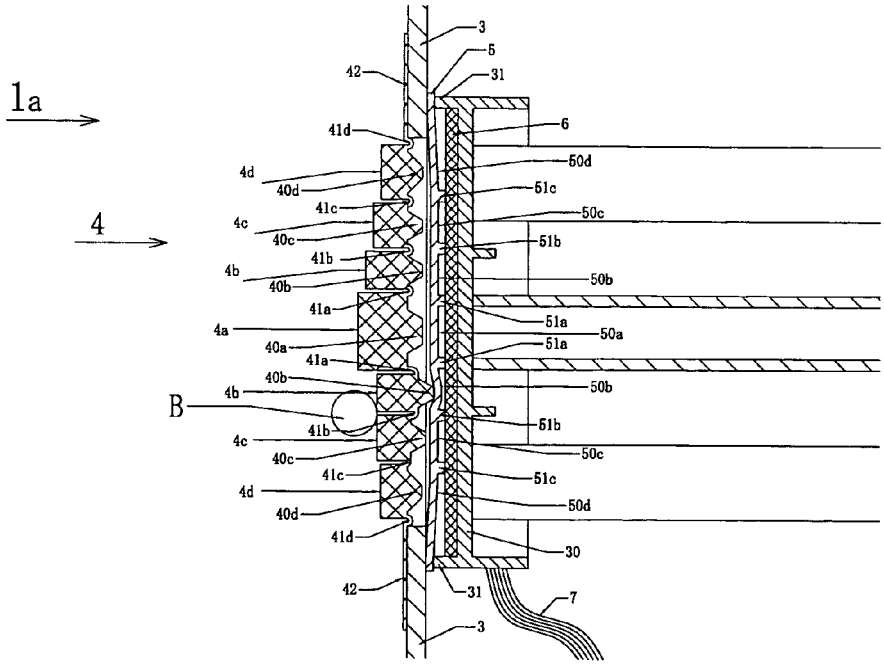
FIG. 7 is a longitudinal cross-section of the target section of the same first embodiment, and shows the situation when a pellet impacts with a boundary of the first ring portion and a second ring portion.

For example, in the event that the pellet B impacts with the first ring section 4*b* of the target surface section 4 as shown in FIG. 6, the first ring-shaped pressing part 40*b* at the rear surface of the first ring section 40*b* presses the corresponding first contact surface 50*b* of the contact plate 5. At this time, in the first embodiment as shown in FIG. 8 and FIG. 9, as the four U-shaped connecting parts 41*a*, 41*b*, 41*c* and 41*d* that are U-shaped in cross-section connect between the circular central section 4*a* and the first ring section 4*b* of the target surface section 4, between the first ring section 4*b* and the second ring section 4*c*, between the second ring section 4*c* and the third ring section 4*d*, and between the third ring section 4*d* and the non-scoring surface 42 so as to form a single integral body, as these parts are formed so as to deform independently, it is difficult for movement due to deformation of the portion pressed by the pellet B to be conveyed to a neighboring part of the target surface section 4. Namely, it is difficult for movement due to deformation of the first ring section 4*b* impacted by the pellet B to be transmitted to the neighboring circular central section 4*a* and the second ring section 4*c* and is barely any linking.

Further, with the second embodiment of a target surface section 8 shown in FIG. 10 and FIG. 11, a plurality of notches 80*a*, 80*b*, 80*c* and 80*d* are provided at appropriate positions, in appropriate numbers and of appropriate dimensions so as to from portion-connecting parts 8*a*, 8*b*, 8*c* and 8*d* that are ring-shaped in cross-section between the circular central section 4*a* and the first ring section 4*b*, the first ring section 4*b* and the second ring section 4*c*, the second ring section 4*c* and the third ring section 4*d*, and the third ring section 4*d* and the non-scoring surface 42 of the target surface section 8. Because of this, the action is such that it is difficult for movement due to deformation of the portion pressed by the pellet B to be conveyed to a neighboring part of the target surface section 4 as with the U-shaped connecting parts 41*a*, 41*b*, 41*c* and 41*d* of the first embodiment. Namely, it is difficult for movement due to deformation of the first ring section 4*b* impacted by the pellet B to be transmitted to the circular central section 4*a* and the second ring section 4*c* and is barely any linking.

Figure 14:
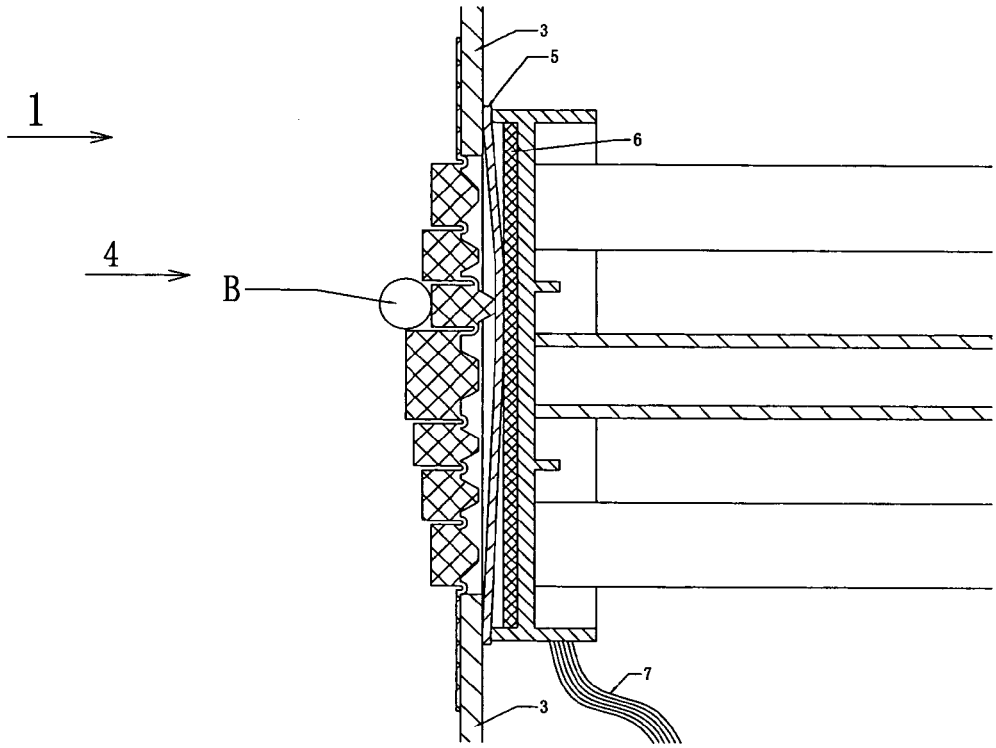
FIG. 14 is a view illustrating operation in the event that a boundary projection is not provided at a contact plate taken as a comparative example for this invention.

The first contact surface 50*b* of the contact plate 5 pressed by the first ring-shaped pressing part 40*b* is surrounded by the first boundary projection 51*a* and the second boundary projection 51*b*. This means that only the first contact surface 50*b* is deformed so as to become depressed at a rear surface side so that contact is made only with the corresponding first terminal 60*b* of the circuit substrate 6. At this time, the first boundary projection 51*a* and the second boundary projection 51*b* do not make contact with the central terminal 60*a* and the second terminal 60*c* positioned so as to correspond to the first boundary projection 51*a* and the second boundary projection 51*b*. A comparative example is now given where each of the boundary projections 51*a*, 51*b* and 51*c* are not present at the contact plate 5 is shown with reference to FIG. 14. In this comparative example, as shown in FIG. 14, the broad area of the contact plate 5 becomes recessed as shown in FIG. 14 and connection with a plurality of terminals 60*x* at the position of contact occurs. This means that a correct signal cannot be sent to the display unit 2.

Further, as shown in FIG. 7, in the event that a pellet B impacts with the boundary of the first ring section 4*b* and the second ring section 4*c* of the target surface section 4, even if the pellet B is substantially to the side of the second ring section 4*c* on the outer side, the first ring section 4*b* that the pellet B impacts with first due to the surface being higher is caused to be indented more. The first contact surface 50*b* of the contact plate 5 corresponding to the first ring-shaped pressing part 40*b* at the rear surface of the first ring section 4*b* is then pressed. In this event, the surface side of the target surface section 4 and the target surface section 8 is formed in such a manner that the circular central section 4*a* is made high, with the rings becoming lower as the third ring section 4*d* at the periphery is approached. However, because the front end surfaces of each of the pressing parts 40*a*, 40*b*, 40*c* and 40*d* formed in a corresponding manner at the rear surface side are provided so as to be flat with respect to each other, it is possible for the contact surface 50*x* corresponding first to the pressing part 40*x* pressed at the highest position to be made contact with first.

Further, movement of the target surface section 4 and the target surface section 8 is as described above. Namely, it is difficult for movement due to deformation of one part pressed by the pellet B to be passed on to the neighboring parts of the target surface section 4. Namely, movement due to deformation of the first ring section 4*b* impacted by the pellet B does not cause much deformation of the neighboring circular central section 4*a* and the second ring section 4*c*.

The first contact surface 50*b* of the contact plate 5 pressed by the first ring-shaped pressing part 40*b* is surrounded by the first boundary projection 51*a* and the second boundary projection 51*b*. This means that only the first contact surface 50*b* is deformed so as to become depressed at a rear surface side so that contact is made only with the corresponding first terminal 60*b* of the circuit substrate 6. At this time, the neighboring central contact surface 50*a* and second contact surface 50*c* do not make contact with the central terminal 60*a* and the second terminal 60*c* corresponding to the first boundary projection 51*a* and the second boundary projection 51*b*.

When the pellet B impacts with the boundary of any one of the surface or border parts of the target surface section 4 of the target section 1, the corresponding contact surface 50*x* of the contact plate 5 is pressed down so as to make contact with one of the terminals 60$x$. This means that only the circuit corresponding to the contacting terminal 60$x$ is excited. This signal is then transmitted to the display unit 2 via the cable 7, and is displayed numerically and instantaneously in an accurate manner. It is then possible to confirm points in a reliable manner in a match or when training by arranging the display unit 2 in such a position as to be visible to the shooter P. It is therefore possible for the shooter P to train in a room such as in their own house etc.

Next, a description is given of a bull's eye target device of a third embodiment of the invention as shown in FIG. 13. FIG. 13 is a vertical cross-sectional view of a target section 1$c$ of a third embodiment. As in FIG. 5, the target section 1$c$ is comprised of a target surface section 4 provided with a circular central section 4$a$ and three concentric ring sections 4$a$, 4$b$ and 4$c$ on the outside of the circular central section 4$a$, and a circuit substrate 6 provided in such a manner as to be spaced so as to enable contact with a pressing end surfaces of each pressing part 40 of the target surface section 4 at the rear surface side of the target surface section 4. Numeral 30 is a substrate case and is fixed to the target case 3.

With the target section 1$c$ of the bull's eye target device of a third embodiment, the contact plate of the target section 1 of the first embodiment and the second embodiment is omitted. The whole of the target surface section 4 or at least just each of the pressing parts 40 formed at the rear surface side of the target surface section 4 are then formed of the same material as the contact plate 5, i.e. are formed from a material that is both conductive and resilient. In this embodiment, the target surface section 4 and the pressing end surfaces of the pressing parts 40 formed at the rear surface side of the target surface section 4 are made of contact rubber. In the embodiment in FIG. 13, the whole of the target surface section 4 is formed of contact rubber.

The target surface section 4 comprised of contact rubber is formed in the same shape as the target surface section 4 of the first embodiment of the invention and the target surface section 8 of the second embodiment. Namely, at the target surface section 4, a circular central pressing part 40$a$ and three circularly projecting rings of a first ring-shaped pressing part 40$b$, second ring-shaped pressing part 40$c$ and third ring-shaped pressing part 40$d$ are formed so as to project in a direction towards the rear surface on the rear surface side so as to correspond to the circular central section 4$a$ and the three ring-shaped sections of the first ring section 4$b$, second ring section 4$c$, and third ring section 4$d$. The pressing end surfaces on the rear surfaces of the circular central pressing part 40$a$, first ring-shaped pressing part 40$b$, second ring-shaped pressing part 40$c$ and third ring-shaped pressing part 40$d$ are arranged in positions so as to be flat with respect to each other and the respectively corresponding terminals 60$a$, 60$b$ and 60$c$ for the circuit substrate 6 spaced by a few mm are provided so as to be spaced at equal intervals.

Next, a description is given of the operation of a bull's eye target device constituting the third embodiment of this invention. With the target surface section 4 and target surface section 8 of the target section 1$c$ of the third embodiment, as with the first embodiment and second embodiment, in the event that a pellet B impacts with one part of the target surface section 4, for example, the first ring section 4$b$, the pressing end surface of the first ring-shaped pressing part 40$b$ at the rear surface of the first ring section 4$b$ makes contact with the first terminal 60$b$ corresponding to the circuit substrate 6. In this event, the action is such that it is difficult for movement due to deformation of the portion pressed by the pellet B to be conveyed to a neighboring part of the target surface section 4. Namely, it is difficult for movement due to deformation of the first ring section 4$b$ impacted by the pellet B to be transmitted to the neighboring circular central section 4$a$ and the second ring section 4$c$ and is barely any linking. This means that contact is not made with the central terminal 60$a$ and the second terminal 60$c$.

Because the whole of the target surface section 4 or at least the pressing end surfaces of the pressing parts 40 formed at the rear surface side of the target surface section 4 are formed of conductive contact rubber, the pressing end surface of the pressing part 40$x$ of the part that is impacted by the pellet B makes contact with the corresponding terminal 60$x$. This means that only the circuit corresponding to the contacted terminal 60$x$ is excited, and this signal is transmitted to the display unit 2 via the cable 7 so as to enable accurate numeric displaying to take place simultaneously. It is then possible to confirm points in a reliable manner in a match or when training by arranging the display unit 2 in such a position as to be visible to the shooter P. It is therefore possible for the shooter P to train in a room such as in their own house etc.

This invention is therefore very useful as a match device for bull's eye target matches using match pistons or as a training device for use in a room in a person's house, etc.

What is claimed is:

1. A bull's eye target device comprising:

a target section and a display unit capable of being electrically connected with the target section, wherein the target section is provided with a target surface section provided with a central section and a plurality of ring sections provided outside the central section so as to be concentric with the central section, and a circuit substrate provided at the rear surface side of the target surface section so as to be distanced from the rear surface of the target surface section, wherein a front surface side of the target surface section is formed in such a manner that the central section is raised to the greatest extent, with the plurality of ring sections becoming relatively lower as the periphery is approached, and a central pressing part and plurality of ring-shaped pressing parts are formed projecting in corresponding shapes at the rear surface side at positions corresponding to the central section and the plurality of ring sections, wherein the circuit substrate is provided with circular or annular independent terminals at positions corresponding to the central pressing part and plurality of ring-shaped pressing parts of the target surface section, wherein the central section and the plurality of ring sections form a monolithic body, and further comprising a corresponding circuit adapted to be energized due to one central pressing part or ring-shaped pressing part making contact with one respectively corresponding terminal of the circuit substrate as a result of a pellet impacting with one of the central section or ring sections of the front side of the target surface section of the target section, so that a signal corresponding to the contacted terminal is sent to the display unit.

2. The bull's eye target device of claim 1, wherein a contact plate capable of deformation when pressed is provided between the target surface section and the circuit substrate, with a space being provided between the circuit substrate and contact plate, provided at the rear surface side of the contact plate, wherein the surface constituting the target surface section side surface of the contact plate is adapted taken to be pressed by the central pressing part and the plurality of ring-shaped pressing parts of the target surface section, and the rear surface side is adapted to be a contacting surface making contact with the circuit substrate in the event of deformation due to pressing, and with boundary projections projecting in ring-shapes being formed at positions corresponding to respective boundaries of the central pressing party and plurality of ring-shaped pressing parts of the target surface section at the rear surface side, wherein the circuit substrate is provided with circular or annular independent terminals at positions corresponding to the central pressing part and plurality of ring-shaped pressing parts of the target surface section, wherein the corresponding circuit is adapted to be energized due to one corresponding central pressing part or ring-shaped pressing part pressing one contact surface of the contact plate as a result of a pellet impacting with one of the circular central section or ring sections of the front side of the target surface section of the target section, so that a signal corresponding to the contacted terminal is sent to the display unit.

3. The bull's eye target device of claim 1, wherein the respective central section and plurality of ring sections of the target surface section are formed in such a manner as to deform independently in the event that a pellet impacts with one of the central section or the ring section at the front surface side, so that a corresponding central pressing part or ring pressing part makes contact with a corresponding terminal of the circuit substrate.

4. The bull's eye target device of claim 2, wherein the respective central section and plurality of ring sections of the target surface section are formed in such a manner as to deform independently in the event that a pellet impacts with one of the central section or the ring section at the front surface side, so that a corresponding central pressing part or ring pressing part makes contact with a corresponding terminal of the circuit substrate.

5. The bull's eye target device of claim 1, wherein the central section and the plurality of ring sections are connected by connecting parts so as to form a monolithic body.

6. The bull's eye target device of claim 5, wherein the connecting parts are U-shaped in cross section.

7. The bull's eye target device of claim 6, wherein the connecting parts are ring-shaped so that the connecting parts are adapted to surround the central portion and the plurality of ring sections.

8. The bull's eye target device of claim 5, wherein the connecting parts comprise notches spaced apart to form connecting portions.

9. The bull's eye target device of claim 8, wherein the connecting portions are ring-shaped.

10. The bull's eye target device of claim 5, wherein the connecting parts connect peripheral edges of the central section and the plurality of ring sections.

11. The bull's eye target device of claim 5, wherein the connecting parts lie in substantially the same plane, wherein the plane runs parallel to the rear surface side of the target surface section.

12. The bull's eye target device of claim 1, wherein the central section and the plurality of ring sections are formed as a single piece of material.

13. A bull's eye target device, comprising:

a target section, including a central section and a plurality of ring sections provided concentrically around the central section;

a circuit adapted to be energized as a result of a pellet impacting with one of the central section or ring sections;

wherein a front surface of the target section is arranged so that the central section is raised to a greatest extent, and the plurality of ring sections are arranged to become relatively lower from the central section outward; and wherein the central section and the plurality of ring sections form a monolithic body.

14. The bull's eye target device of claim 13, further comprising a central pressing part and a plurality of ring-shaped pressing parts that project at the rear surface of the target section at positions corresponding to the central section and the plurality of ring sections.

15. The bull's eye target device of claim 14, further comprising a circuit substrate provided at the rear surface side of the target section so as to be distance from the rear surface of the target section.

16. The bull's eye target device of claim 15, wherein the circuit substrate is provided with independent terminals at positions corresponding to the central pressing part and the plurality of ring-shaped pressing parts.

17. The bull's eye target device of claim 13, wherein the central section and the plurality of ring sections are connected by connecting parts.

18. The bull's eye target device of claim 17, wherein the connecting parts are U-shaped in cross section.

19. The bull's eye target device of claim 18, wherein the connecting parts are ring-shaped so that the connecting parts are adapted to surround the central portion and the plurality of ring sections.

20. The bull's eye target device of claim 17, wherein the connecting parts comprise notches spaced apart to form connecting portions.

21. The bull's eye target device of claim 20, wherein the connecting portions are ring-shaped.

22. The bull's eye target device of claim 17, wherein the connecting parts connect peripheral edges of the central section and the plurality of ring sections.

* * * * *